US006655980B2

(12) United States Patent
Lee

(10) Patent No.: US 6,655,980 B2
(45) Date of Patent: Dec. 2, 2003

(54) ELECTRICAL CONNECTOR HAVING LOCKS

(75) Inventor: George Lee, Tu-Chen (TW)

(73) Assignee: Hon Hai Precision Ind. Co., Ltd., Taipei Hsien ( * ) Notice: Subject to any disclaimer, the term of this patent is extended or adjusted under 35 U.S.C. 154(b) by 0 days.

(21) Appl. No.: 10/120,677

(22) Filed: Apr. 10, 2002

(65) Prior Publication Data

US 2003/0194900 A1 Oct. 16, 2003

(51) Int. Cl.[7] ..... H01R 13/627
(52) U.S. Cl. ..... 439/358; 439/405
(58) Field of Search ..... 439/350, 352, 439/353, 354, 357, 358, 372, 406, 417, 404, 470

(56) References Cited

U.S. PATENT DOCUMENTS 4,006,957 A * 2/1977 Narozny ..... 439/405
4,842,542 A * 6/1989 Davis ..... 439/357
5,151,049 A * 9/1992 Mosquera ..... 439/353
5,154,629 A * 10/1992 Carver et al. ..... 439/352
5,332,330 A * 7/1994 Kaneko ..... 403/321
5,352,132 A * 10/1994 O'Keefe et al. ..... 439/346
6,171,131 B1 * 1/2001 Lee ..... 439/358
6,371,788 B1 * 4/2002 Bowling et al. ..... 439/358

* cited by examiner

*Primary Examiner*—Hien Vu
(74) *Attorney, Agent, or Firm*—Wei Te Chung

(57) ABSTRACT

An electrical connector (1) includes an insulative housing (10) with a number of terminals retained therein and a pair of locks (30) pivotally mounted on opposite ends of the housing. Each lock includes a body portion (32), a handle (34) at one end of the body portion for manually pivoting the lock, a latch (36) at an opposite end of the body portion for latchably engaging with a complementary connector (4) and a spring portion (38) between the handle and the latch. The spring portion forces the latch to a closed position at the sides of the housing.

6 Claims, 13 Drawing Sheets

ELECTRICAL CONNECTOR HAVING LOCKS

BACKGROUND OF THE INVENTION

1. Field of the Invention

The present invention relates to an electrical connector, and particularly to an electrical connector having locks for ensuring a reliable connection between the connector and a complementary connector.

2. Description of Related Art

As is well known, SCSI (Small Computer System Interface) connectors provide a standard interface between computers and internal/external SCSI peripheral devices, such as fixed and removable storage drives, scanners, compact discs, etc. Generally, an electrical connection is established between a computer and an internal/external SCSI peripheral device via a SCSI ribbon cable. One end of the SCSI ribbon cable is directly connected with the internal/external SCSI device, and another end of the SCSI ribbon cable is assembled with an IDC (Insulation Displacement Contact) SCSI 3 plug connector to be plugged into a complementary SCSI 3 receptacle connector, which is mounted on a circuit board of the computer. However, due to inevitable vibration and shock, the connection between the IDC plug connector and the complementary receptacle connector is relatively to loose. As a result, signal transmission between the computer and the internal/external SCSI device may be adversely affected.

Hence, the present invention aims to provide an electrical connector having locks to ensure a reliable connection between the connector and a complementary connector.

SUMMARY OF THE INVENTION

Accordingly, a first object of the present invention is to provide an electrical connector having locks for ensuring a reliable connection between the connector and a complementary connector.

A second object of the present invention is to provide a lock pivotally mounted on an electrical connector and having a spring portion forcing the lock to reliably latch with a complementary connector.

In order to achieve the objects set forth, an electrical connector having locks in accordance with the present invention comprises an insulative housing with a plurality of terminals retained therein, and a pair of locks pivotally mounted on opposite ends of the housing. Each lock includes a body portion, a handle at one end of the body portion for manually pivoting the lock, a latch at an opposite end of the body portion for latchably engaging with a complementary connector and a spring portion between the handle and the latch. The spring portion can always force the latch to approaching the housing to latchably engage with the complementary connector, thereby ensuring a reliable connection between the connector and a complementary connector.

Other objects, advantages and novel features of the invention will become more apparent from the following detailed description when taken in conjunction with the accompanying drawings.

DETAILED DESCRIPTION OF THE INVENTION

Figure 1:
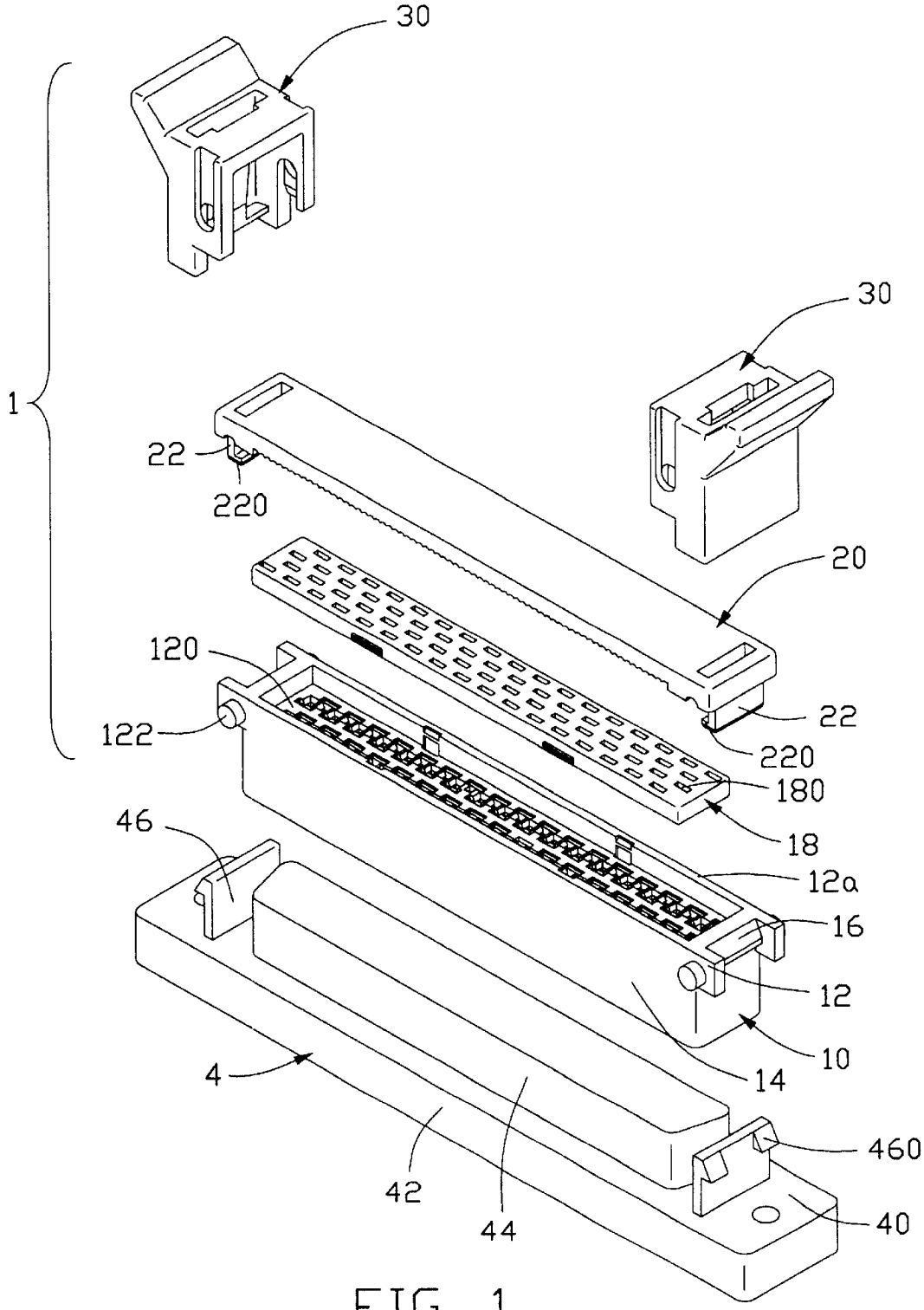
FIG. 1 is an exploded, perspective view of a plug connector having a pair of locks in accordance with a first embodiment of the present invention, and a complementary receptacle connector.
Figure 5:
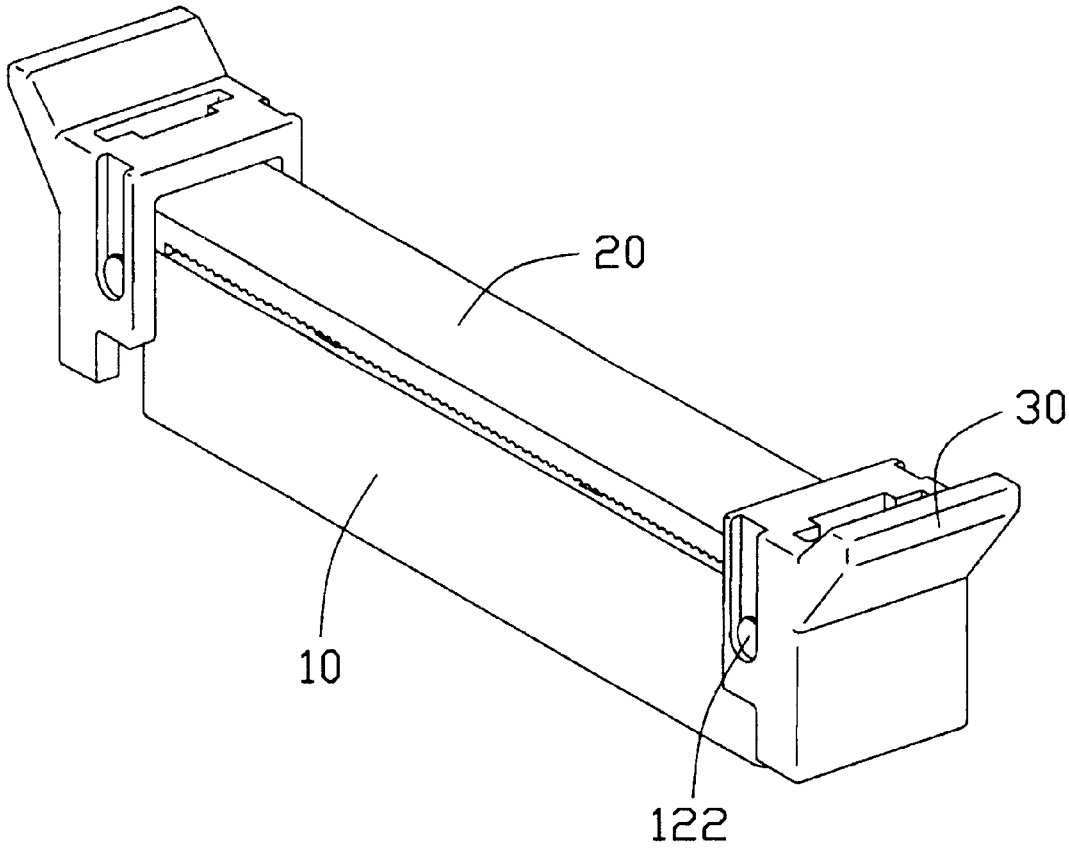
FIG. 5 is an assembled, perspective view of the plug connector of FIG. 1.
Figure 6:
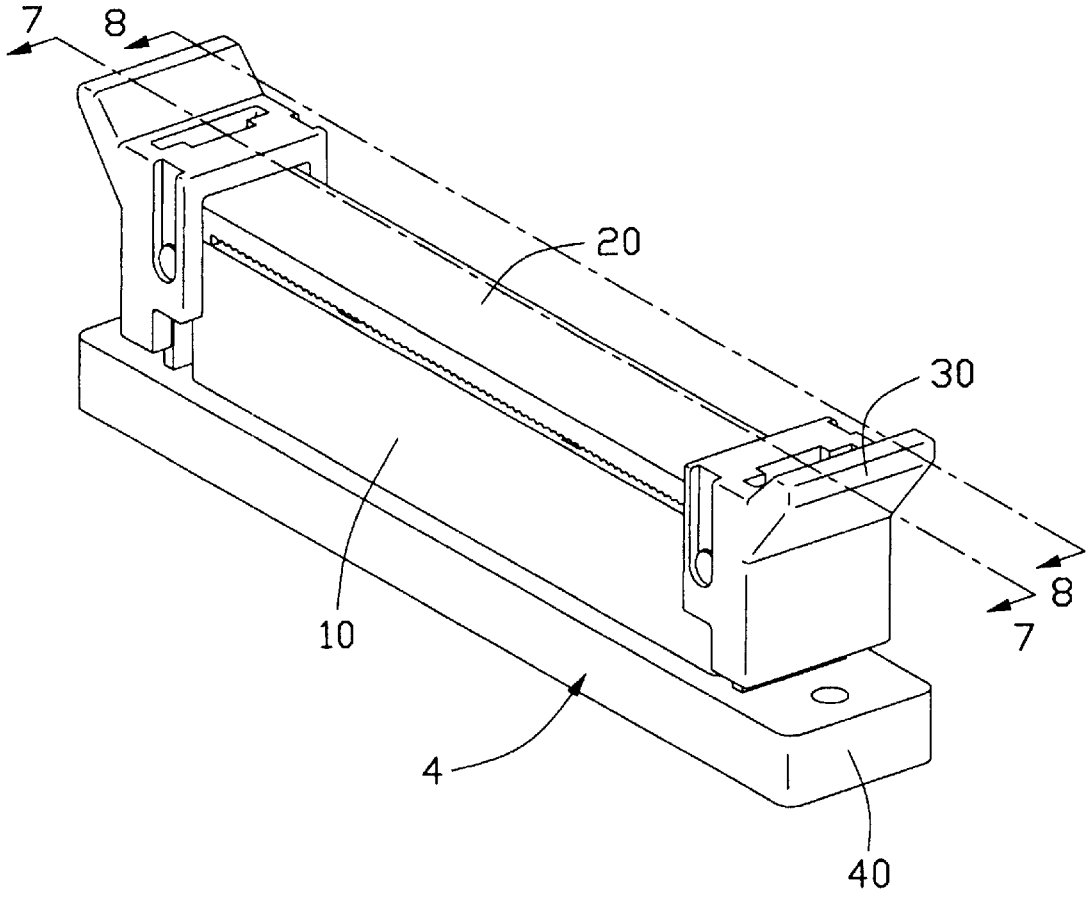
FIG. 6 is a perspective view showing the plug connector of FIG. 5 engaged with the complementary receptacle connector.
Figure 7:
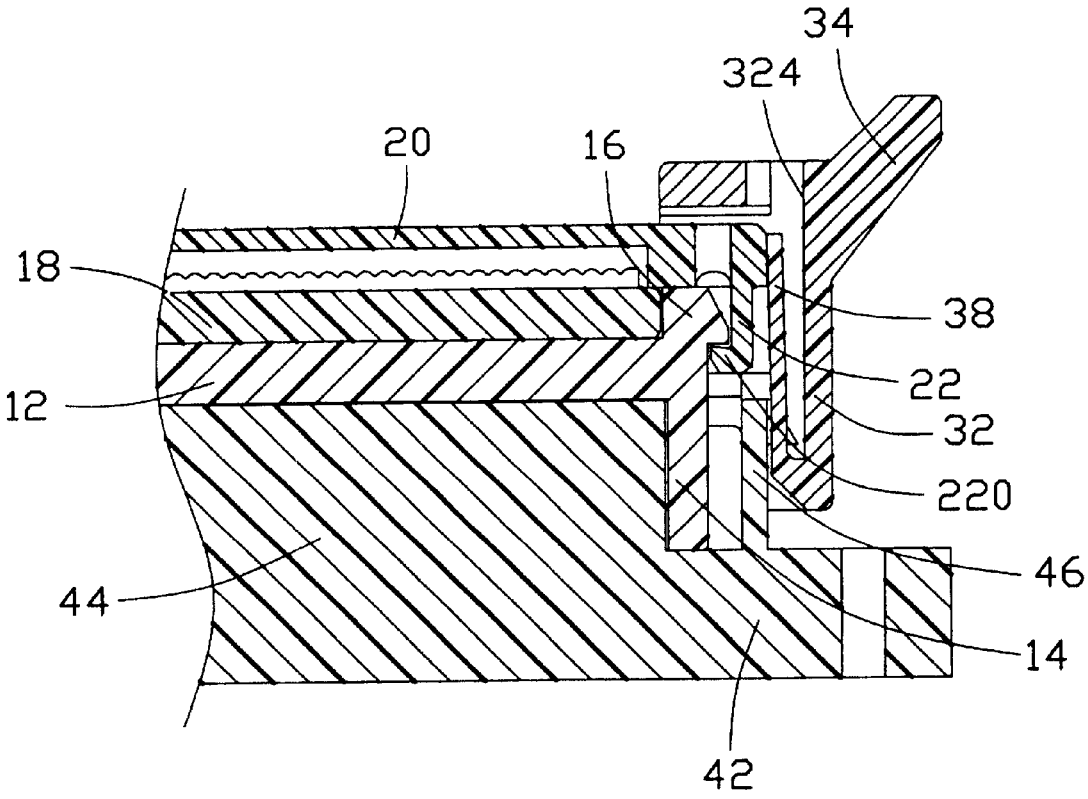
FIG. 7 is a partial, cross-sectional view taken along section line 7—7 in FIG. 6, showing the locks in a closed position.
Figure 8:
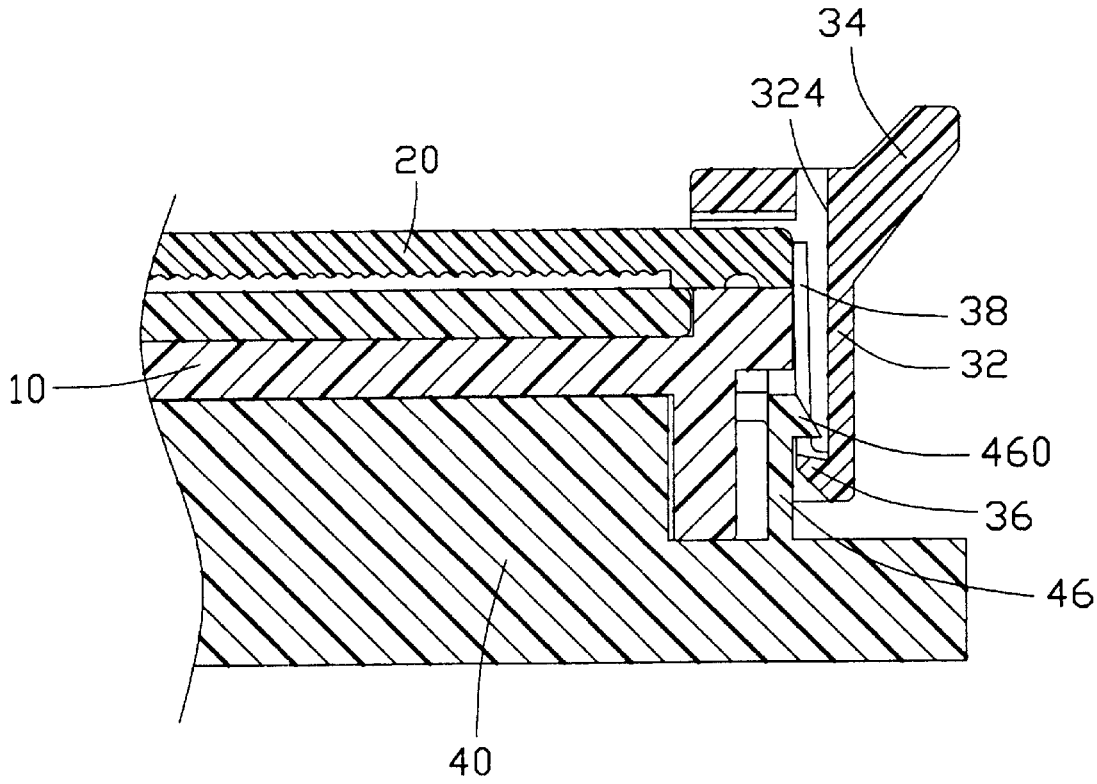
FIG. 8 is a partial, cross-sectional view taken along section line 8—8 in FIG. 6, showing the locks in the closed position.
Figure 9:
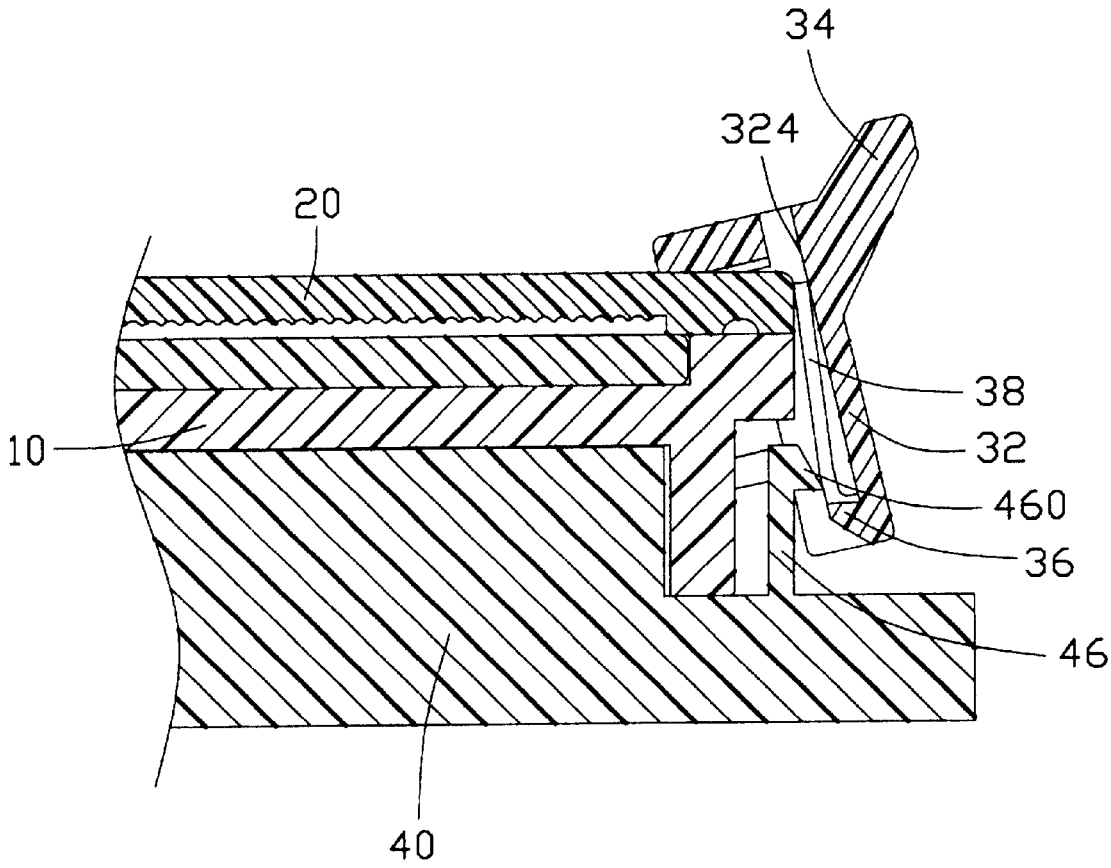
FIG. 9 is a view similar to FIG. 8 but showing the locks in an open position.
Figure 10:
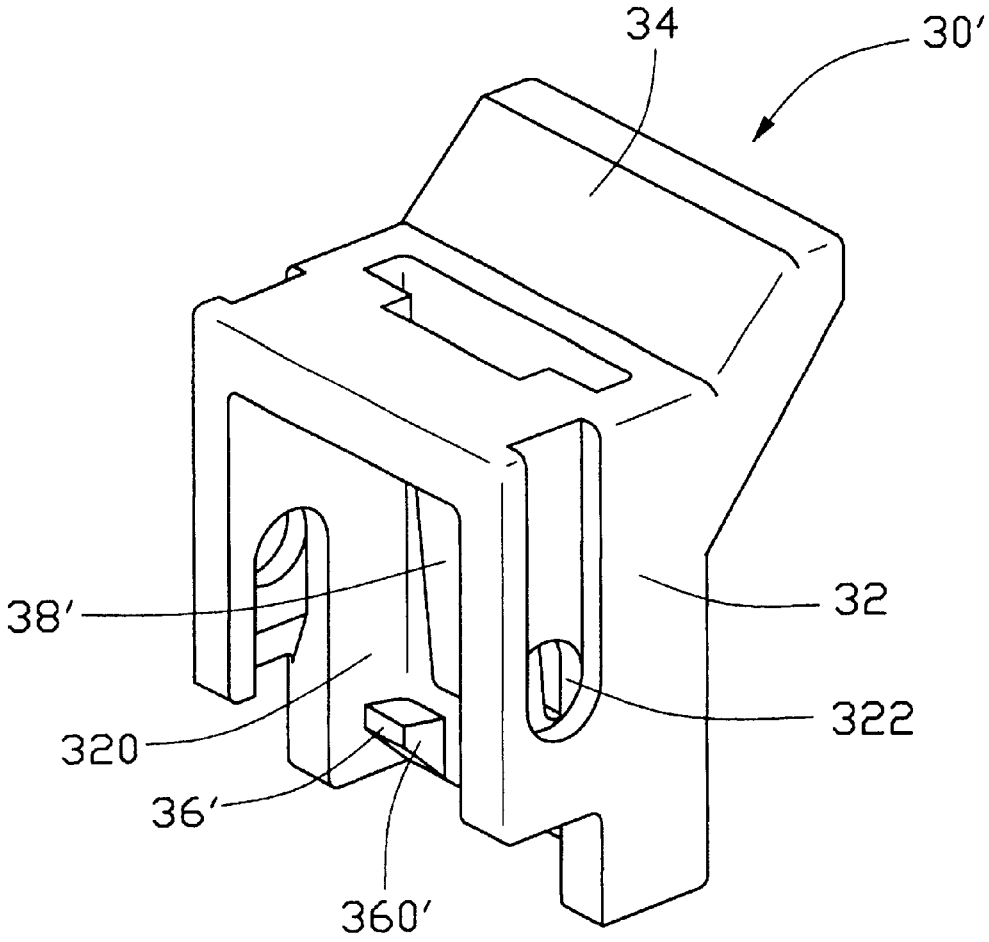
FIG. 10 is an enlarged, perspective view of a lock in accordance with a second embodiment of the present invention.
Figure 11:
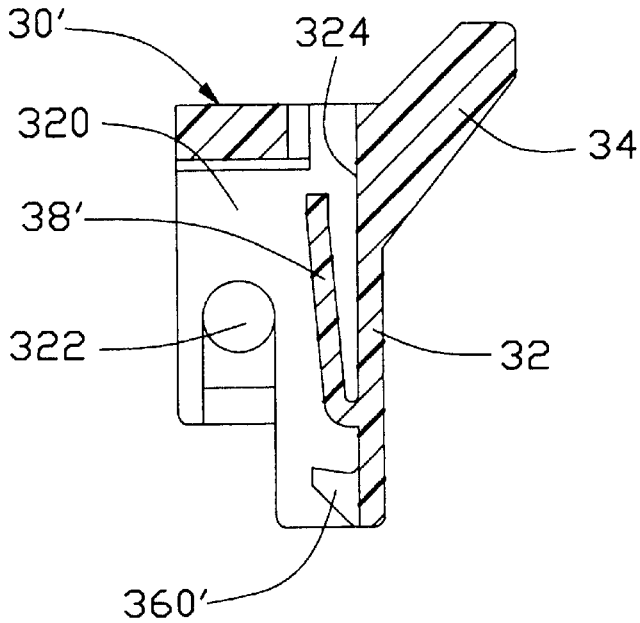
FIGS. 11 and 12 are cross-sectional views of the lock in FIG. 10 taken along different section lines.
Figure 12:
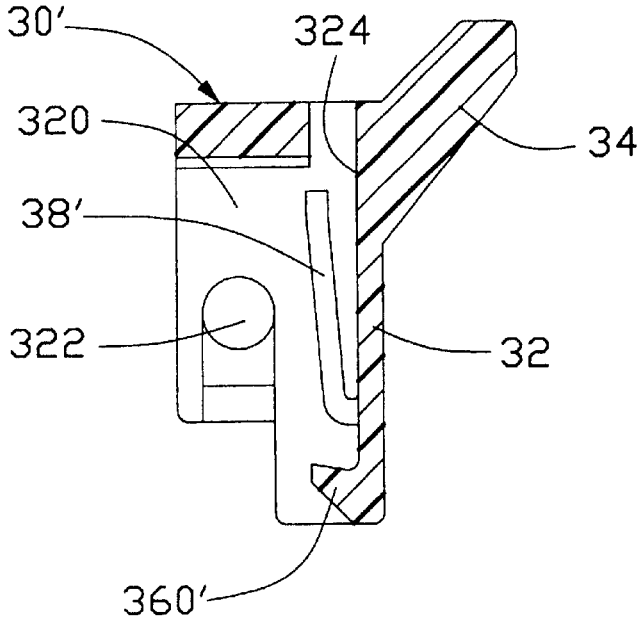
Figure 13:
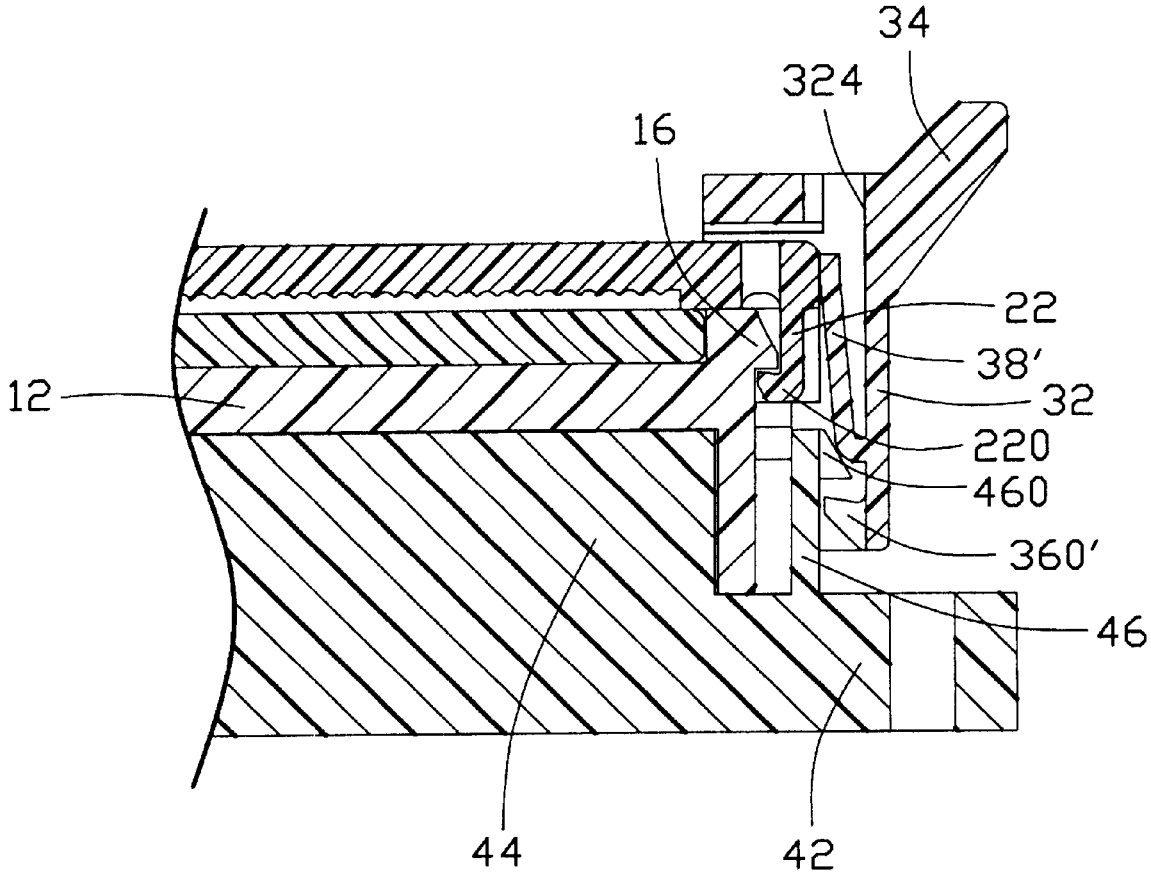
FIG. 13 is a partial, cross-sectional view showing the plug connector engaged with the receptacle connector and the locks of FIG. 10 in a closed position.
Figure 14:
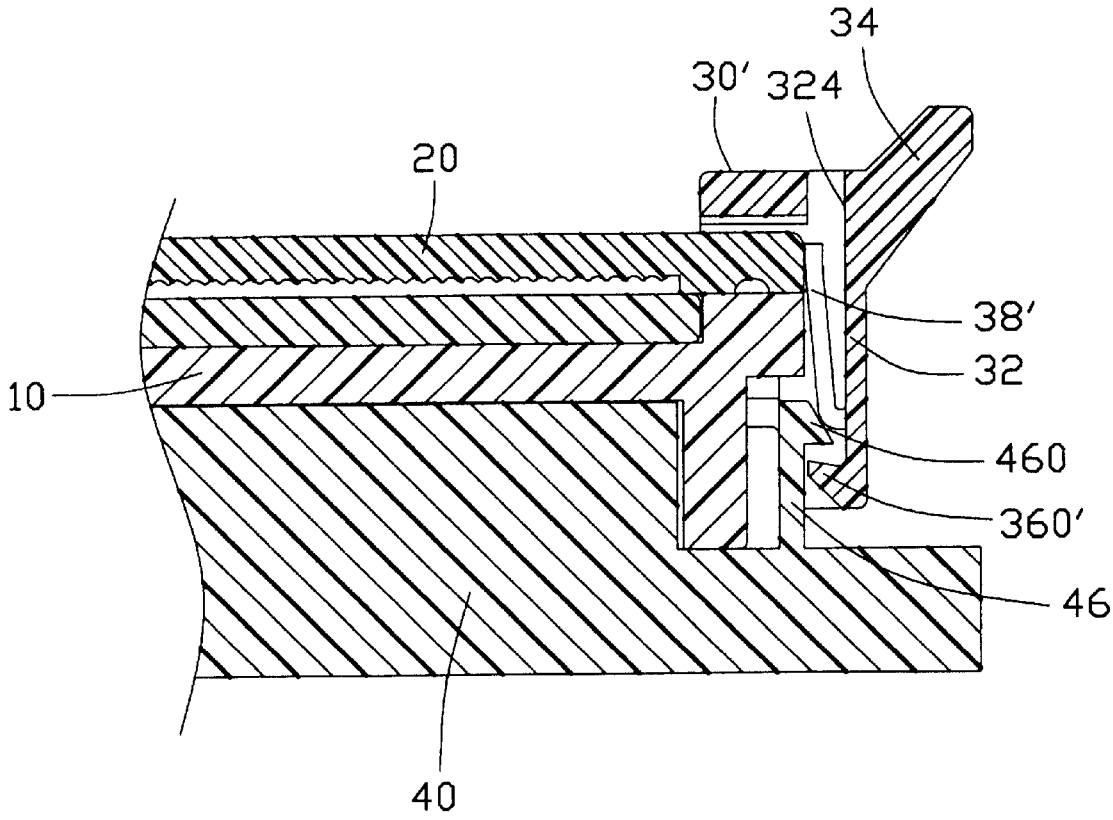
FIG. 14 is a view similar to FIG. 13 but taken from a different section.
Figure 15:
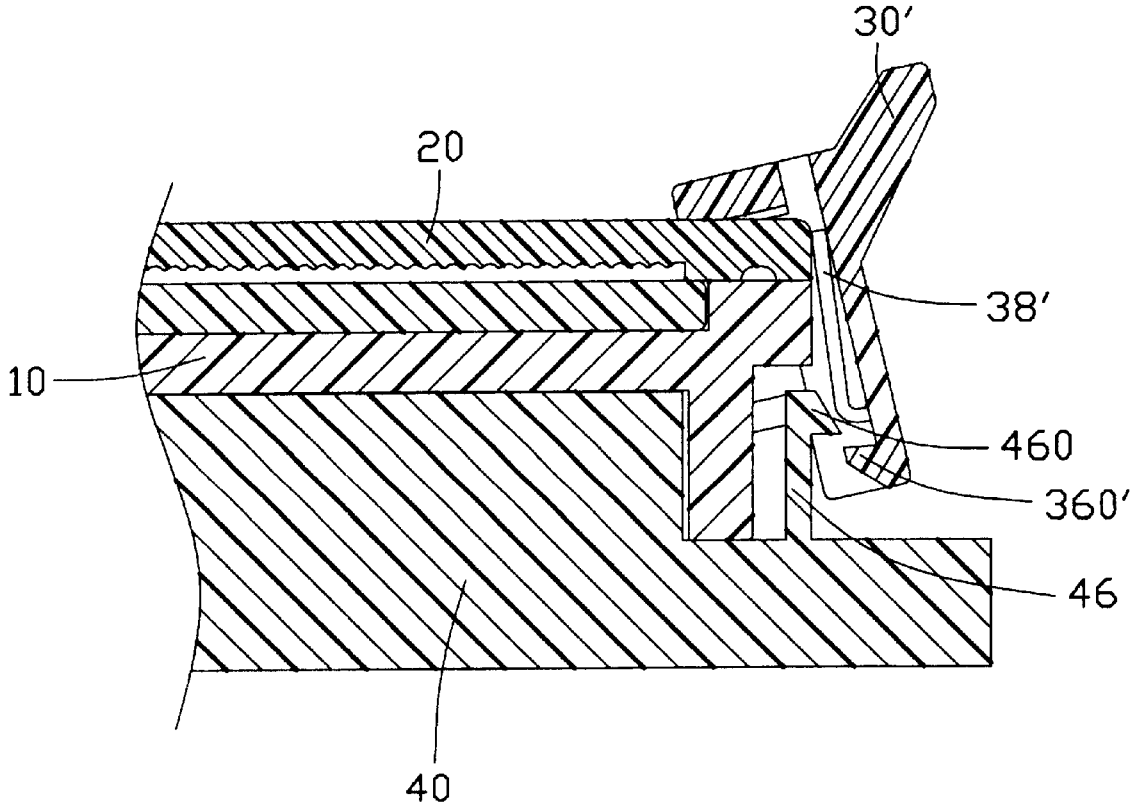
FIG. 15 is a view similar to FIG. 14 but showing the locks in an open position.

Referring to FIGS. 1 and 5, an electrical connector 1 having a pair of locks 30 in accordance with a first embodiment of the present invention and a complementary connector 4 adapted for mating with the connector 1 are shown. In a preferred embodiment of the present invention, the connector 1 is an IDC SCSI plug connector and the complementary connector 4 is an ultra SCSI receptacle connector which is mounted on a circuit board (not shown) of a computer.

The plug connector 1 comprises an insulative first housing 10 with a plurality of terminals (not shown) retained therein, a spacer 18 for being disposed on the first housing 10 for positioning insulation displacement portions of the terminals, a termination cover 20 for being latchably mounted on the first housing 10 and a pair of locks 30 for being pivotally mounted to opposite ends of the first housing 10. The first housing 10 includes a base 12 and a shroud 14 downwardly projecting from the base 12. The base 12 has a cavity 120 in a top face 12*a* thereof and a pair of mounting wedges 16 at opposite ends thereof. The base 12 is also formed with a pair of pivots 122 at each end thereof.

The spacer 18 is installed into the cavity 120 of the first housing 10. The spacer 18 defines a plurality of positioning holes 180 arranged in four rows in a staggered manner for the insulation displacement portions of the terminals to extend therethrough.

The termination cover 20 is mounted on the top face 12*a* of the first housing 10 for performing electrical connections between a multi-conductor ribbon cable (not shown) and the insulation displacement portions of the terminals. The termination cover 20 includes a pair of downwardly extending mounting lugs 22 at opposite ends thereof. Each mounting lug 22 has an inward projection 220 at a free end thereof for engaging with a corresponding mounting wedge 16 of the first housing 10.

Figure 2:
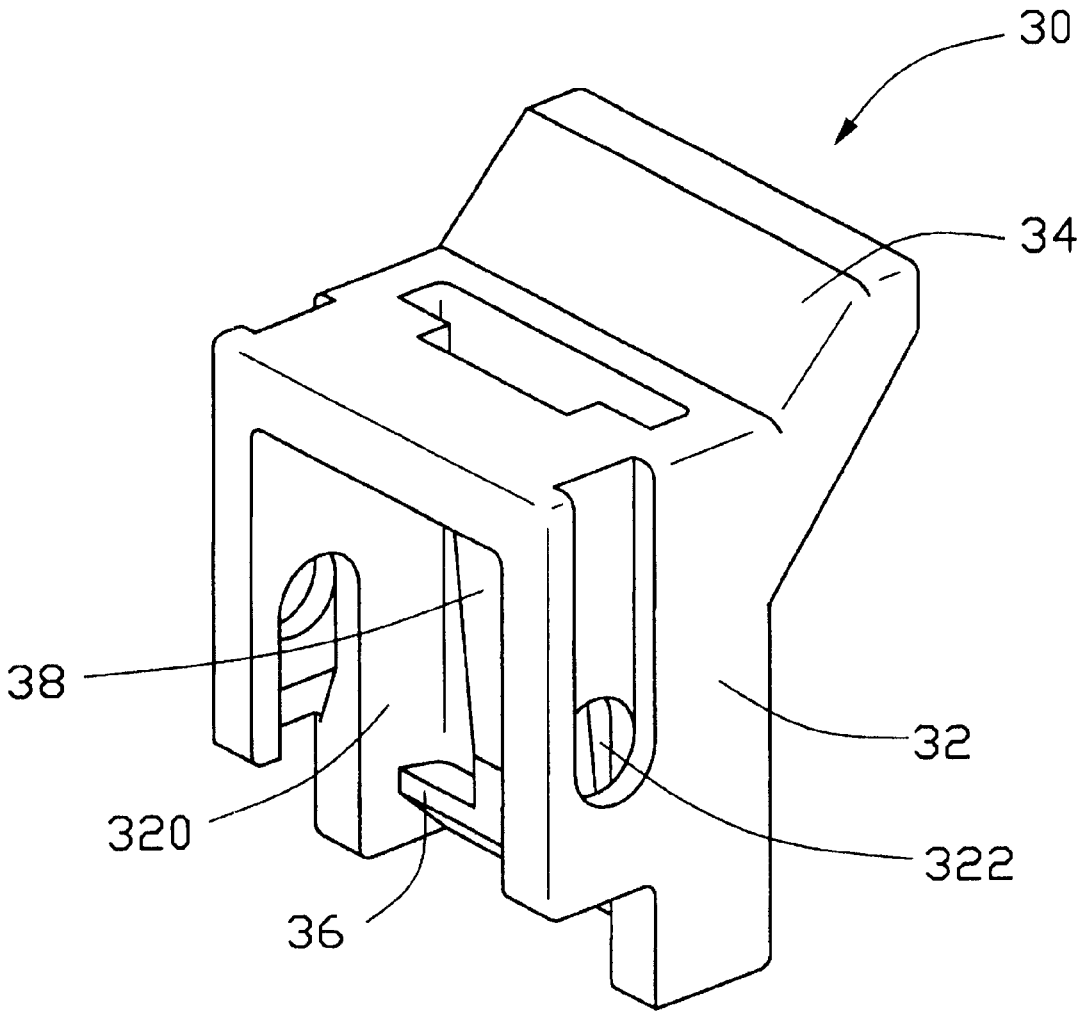
FIG. 2 is an enlarged, perspective view of a lock shown in FIG. 1.
Figure 3:
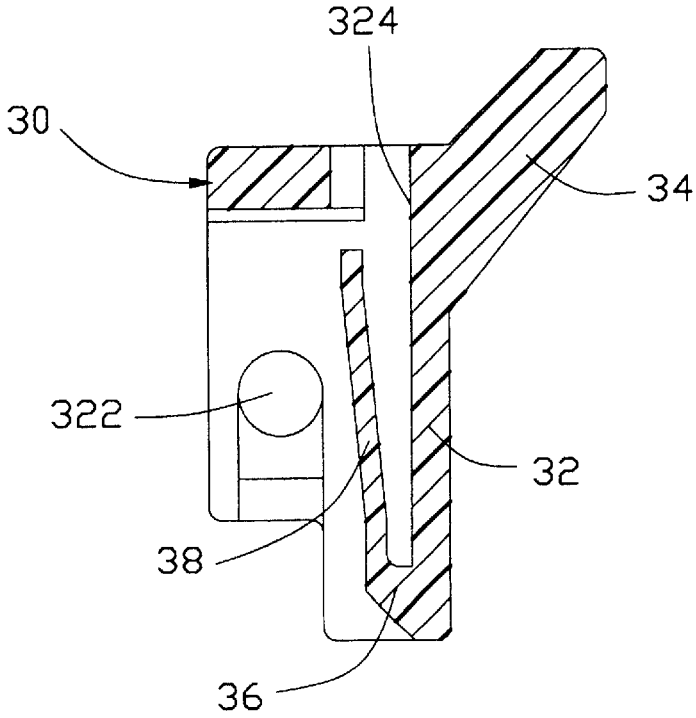
FIGS. 3 and 4 are cross-sectional views of the lock in FIG. 2 taken along different section lines.
Figure 4:
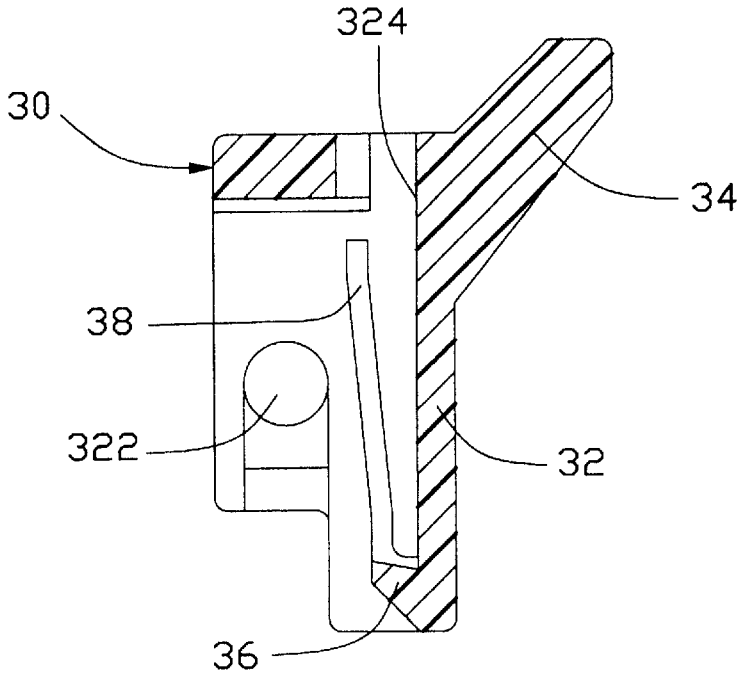

Referring to FIGS. 2, 3 and 4, the pair of locks 30 are pivotally mounted on the opposite ends of the first housing 10. Each lock 30 includes a body portion 32 having a chamber 320 defined therein, an outwardly extending handle 34 at one end of the body portion 32 for manually pivoting the lock 30, an inwardly extending latch 36 at an opposite end of the body portion 32, and a spring portion 38 integrally and upwardly extending from the body portion 32 and disposed in the chamber 320 of the body portion 32. The body portion 32 defines a pair of holes 322 in opposite sidewalls thereof. Each hole 322 is in communication with the chamber 320 for receiving a corresponding pivot 122 on the first housing 10.

Referring to FIG. 5, in assembly, the spacer 18 is first disposed in the cavity 120 of the first housing 10 with the insulation displacement portions of the terminals extending therethrough. The termination cover 20 is then mounted on the first housing 10 to facilitate electrical connection between the multi-conductor ribbon cable and the insulation displacement portions of the terminals. The mounting lugs 22 of the termination cover 20 engage with the mounting wedges 16 of the first housing 10. Finally, the locks 30 are pivotally mounted on the first housing 10 via the engagement between the holes 322 of the body portions 32 and the pivots 122 of the first housing 10. At the same time, the mounting lugs 22 of the termination cover 20 and the mounting wedges 16 of the first housing 10 are accommodated in the chambers 320 of the locks 30. Free ends of the spring portions 38 of the locks 30 abut against the opposite ends of the termination cover 20.

Referring back to FIG. 1, the receptacle connector 4 comprises an insulative second housing 40 with a plurality of terminals (not shown) retained therein. The second housing 40 includes a base section 42 and a mating section 44 (only shown with the outer contour in FIG. 1) upwardly extending from the base section 42 for being received in the shroud 14 of the plug connector 1. The base section 42 is formed with a pair of upwardly extending hooks 46 at opposite ends thereof. Each hook 46 has a pair of outwardly protruding projections 460 at a free end thereof.

Referring to FIGS. 6–9, before mating the plug connector 1 with the receptacle connector 4, an external force is exerted inward on the handles 34 to actuate a bottom edge of each lock 30 to pivot outwardly until the locks 30 arrive at an open position where free ends of the spring portions 38 are deflected to abut against inner surfaces 324 of the body portions 32. After the plug connector 1 mates with the receptacle connector 4, the external force is removed from the handles 34 and the spring portions 38 spring back to cause the locks 30 to arrive at a closed position where the latches 36 of the locks 30 engage with the projections 460 of the hooks 46 of the receptacle connector 4, whereby a reliable electrical connection between the plug connector 1 and the receptacle connector 4 is ensured.

When separation between the plug connector 1 and the receptacle connector 4 is required, an external force is exerted inward on the handles 34 to actuate the bottom edges of the locks 30 to pivot outwardly about the pivots 122 until the latches 36 completely disengage from the projections 460 of the hooks 46 of the second housing 40. Then, the plug connector 1 can be easily removed from the receptacle connector 4.

FIGS. 10–15 show a pair of locks 30' in accordance with a second embodiment of the present invention. Each lock 30' has a configuration substantially the same as that of the lock 30, except that a spring portion 38' of the lock 30' is separated from a latch 36' and the latch 36' includes a pair of keys 360' (only one is shown) on the inner surface 324 of the body portion 32.

It is noted that once the external force is removed from the handles 34 of the locks 30, 30', the spring portions 38, 38' always reform to their original position to keep the locks 30, 30' in the closed position, i.e., the locks 30, 30' can automatically return to the closed position. Thus, a reliable connection between the plug connector 1 and the receptacle connector 4 is ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a cavity; and a pair of discrete locks pivotally mounted to opposite ends of the housing, each lock including a body portion, a handle at one end of the body portion for manually operating the at least one lock, causing the at least one lock to pivot about the portion of the housing, a latch at an opposite end of the body portion for latchably engaging with a complementary connector, and a spring portion formed from the body portion and extending upwardly therefrom, the spring portion forcing the latch to a closed position with respect to the housing; wherein the latch includes a pair of keys projecting from the body portion toward the housing; wherein the body portion of the lock defines a pair of holes in opposite sides thereof, and the housing provides a pair of pivots pivotally received in the respective holes of the lock; further comprising a termination cover mounted on the insulative housing, and a spacer with a plurality of holes fitted in the cay and positioned between the cover and the insulative housing, the termination cover having a pair of mounting lugs extending downwardly at opposite ends thereof to separately engage with the insulative housing.

2. The electrical connector as claimed in claim 1, wherein the housing has a pair of mounting wedges at opposite ends thereof engaging with the mounting lugs of the termination cover.

3. An electrical connector assembly comprising:

a first connector including a first housing having a cavity;

a second connector matchable with the first connector and including a second housing having a pair of hooks formed at opposite ends thereof; and a pair of discrete locks pivotally mounted on opposite ends of the first housing, each lock including a body portion, a handle at one end of the body portion for manually pivoting the lock, a latch at an opposite end of the body portion for engaging with a corresponding hook of the second connector, and a spring portion formed from the body portion and extending upwardly therefrom;

wherein when the first connector is required to be disconnected from the second connector, the locks are pushed to pivot outwardly to arrive at an open position where free ends of the spring portions abut against inner surfaces of the body portions and the latches of the locks are completely disengaged from the hooks of the second connector, and when the first connector engages with the second connector, the spring portions spring back to force the locks to a closed position where the latches engage with the hooks of the second housing; wherein the latch includes a pair of keys on the inner surface of the body portion; further comprising a termination cover positioned on the first housing, a spacer with a plurality of holes fitted in the cavity and positioned between the cover and the insulative housing, the termination cover including a pair of mounting lugs extending downwardly at opposite ends thereof to separately engage with the first housing.

4. The electrical connector assembly as claimed in claim 3, wherein the body portion defines a chamber accommodating the spring portion therein.

5. The electrical connector assembly as claimed in claim 4, wherein the body portion of the lock defines a pair of holes in opposite sidewalls thereof in communication with the chamber, and the first housing provides a pair of pivots pivotally received in the respective holes of the lock.

6. The electrical connector assembly as claimed in claim 3, wherein the first housing has a pair of mounting wedges formed at opposite ends thereof for engaging with the mounting lugs of the termination cover.

* * * * *